US007025094B2

(12) United States Patent
Vanderjeugt et al.

(10) Patent No.: US 7,025,094 B2
(45) Date of Patent: Apr. 11, 2006

(54) DEVICE FOR ATTACHING RETURN SPRINGS IN A HARNESS OF A JACQUARD WEAVING MACHINE

(75) Inventors: Bram Vanderjeugt, Ieper (BE); Yvan Lauwereys, Schellebelle (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 298 days.

(21) Appl. No.: 10/620,800

(22) Filed: Jul. 17, 2003

(65) Prior Publication Data

US 2004/0035488 A1 Feb. 26, 2004

(30) Foreign Application Priority Data

Jul. 19, 2002 (BE) ..... 2002/0451

(51) Int. Cl.
*D03C 3/00* (2006.01)
*D03C 3/14* (2006.01)

(52) U.S. Cl. ..... 139/59; 139/60; 139/61; 139/62; 139/63; 139/64; 139/65; 139/85; 139/86; 139/87

(58) Field of Classification Search ..... 139/59–65, 139/85–87

See application file for complete search history.

(56) References Cited

U.S. PATENT DOCUMENTS 4,125,135 A * 11/1978 Ebisch ..... 139/456
4,161,969 A * 7/1979 Neyraud ..... 139/90
4,566,499 A * 1/1986 Kitagawa et al. ..... 139/59
5,636,663 A * 6/1997 Lacroix ..... 139/86
5,791,382 A * 8/1998 Froment et al. ..... 139/85
5,819,809 A * 10/1998 Bassi et al. ..... 139/85

(Continued)

FOREIGN PATENT DOCUMENTS

DE 2142953 5/1972

(Continued)

*Primary Examiner*—John J. Calvert
*Assistant Examiner*—Robert Muromoto
(74) *Attorney, Agent, or Firm*—James Creighton Wray; Meera P. Narasimhan

(57) ABSTRACT

On the one hand, the invention relates to a device for exerting a return force on at least one harness element of the harness of a Jacquard weaving machine, comprising at least one return spring (2) provided with means of attachment (1) for attaching the return spring (2) to retaining means (4) being immovably provided, said means of attachment (1) being provided with a positioning opening (6) for positioning the means of attachment (1) with respect to the retaining means (4), and a fixing opening (7) for fixing the means of attachment (1) to the retaining means (4), a spring connection (8) being provided between the positioning opening (6) and the fixing opening (7), in such a manner that the means of attachment (1) are able to move from positioning opening (6) to the fixing opening (7) with respect to the retaining means (4), but after having been fixed will be unable to move back from the fixing opening (7) to the positioning opening (6) with respect to the retaining means during operation or transport of the Jacquard machine.

On the other hand, the invention relates to a device for immovably installing the retaining means (4) of one or several return springs (2) of a Jacquard weaving machine, the device being provided with at least two fixed installing elements (13) for installing the retaining means (4), the said installing elements (13) being provided with one or several recesses to apply the retaining means (4).

13 Claims, 3 Drawing Sheets

U.S. PATENT DOCUMENTS

| | | | | |
|---|---|---|---|---|
| 6,289,937 | B1 | 9/2001 | Feer | |
| 6,302,154 | B1 | 10/2001 | Bassi et al. | |
| 6,328,076 | B1 * | 12/2001 | Speich | 139/55.1 |
| 6,367,512 | B1 * | 4/2002 | Feer | 139/93 |
| 6,382,263 | B1 * | 5/2002 | Dewispelaere | 139/455 |
| 6,478,055 | B1 * | 11/2002 | Dewispelaere | 139/455 |
| 6,886,223 | B1 * | 5/2005 | Lemfeld et al. | 24/115 R |

FOREIGN PATENT DOCUMENTS

| | | |
|---|---|---|
| DE | 19512887 | 3/1996 |
| EP | 0292632 | 11/1988 |
| FR | 2 114 285 | 6/1972 |
| FR | 2 756 849 | 6/1998 |
| WO | WO98 24956 | 6/1998 |

* cited by examiner

DEVICE FOR ATTACHING RETURN SPRINGS IN A HARNESS OF A JACQUARD WEAVING MACHINE

This application claims the benefit of Belgian Application No. 2002/0451 filed Jul. 19, 2002.

BACKGROUND OF THE INVENTION

On the one hand, the invention relates to a device for exerting a return force on at least one harness element of the harness of a Jacquard weaving machine, comprising at least one return spring provided with means of attachment in order to attach the return spring to retaining means immovably provided. On the other hand, the invention relates to a device for immovably installing the retaining means of one or several return springs of a jacquard weaving machine, the device being provided with at least two fixed installing elements for installing the retaining means.

In a Jacquard machine, one or several return springs are applied at the bottom of the harness, in order to tighten the Jacquard heddle, the harness cord, the tackles, the tackle cords and the two complementary hooks, so that the noses of the hooks will be kept permanently in touch with the blades or, in case of a selection, will certainly stay on the suspension means. The spring force of these return springs at the bottom of the harness will compensate the tension of the pile warp yarn, the inertia and the friction of the heddles, of the harness cord, of the tackles with their cords and of the hooks. Most of the time, the return springs are connected to a fastening piece, which is provided with a hook, by which each return spring is attached to a board, called flat bar, which is built-in in the machine. This fastening piece may be screwed onto the return spring, which is or is not provided with damping means (=element of synthetic material situated in the return spring in order to prevent the extremity of the return spring from absorbing the heaviest chocks). The hook is usually a metal hook, which is hooked onto the flat bar.

This design has the disadvantage, that the return springs which have been installed on the flat bar next to one another, are not self-gripping what causes the return springs to loose their exact positions, each time the harness is released and because of this the position of the return springs in the warp direction becomes uncertain and no longer in correspondence with the pitch of the cumber board. Because of this, friction in the harness will increase or it may lead to a hooking together of the springs in case of major dimensional deviations. When the foremost return springs are shifting forward too far they may collide with the reed. The shed also may change in consequence of the position lost in the warp direction, because of which the rapier may collide with the shed.

In order to better secure the position in the warp direction designs are known where the return spring is glued to the flat bars.

This has the disadvantage that replacement on site becomes very difficult.

Another design consists in bringing in spacers on the flat bars between the various return springs and then tightening the whole.

However this design has the disadvantage that a large variety of spacers are required with different thicknesses requiring quite some work for installation. Here, replacements on site are also labor-intensive.

Another solution to be applied is overmoulding the flat bars. During the production process of the hooks, the flat bars are inserted, so that the hooks are overmoulded directly at the distances required.

The disadvantage of this method is that a large number of parts have to be overmoulded simultaneously. Besides, this production method is hardly flexible and replacement on site becomes very difficult.

SUMMARY OF THE INVENTION

On the one hand, the purpose of the invention is to provide a device for exerting a retracting force on at least one harness element of the harness of a Jacquard weaving machine, not having the above-mentioned disadvantages.

Furthermore, an additional purpose of the invention is to be able to position the return spring exactly on the flat bars, without the position being changed during transport or operating conditions.

Furthermore a purpose is to obtain a harness with a minimum friction and reducing collisions between the various harness components to a minimum.

These purposes are obtained by providing a device for exerting a retractive force on at least one harness element of the harness of a Jacquard weaving machine, comprising at least one return spring which is provided with means of attachment for attaching the return spring to the retaining means which are immovably provided, but the means of attachment being provided with a positioning opening for positioning the means of attachment with respect to the retaining means and a fixing opening for fixing the means of attachment to the retaining means, a spring connection being provided between the positioning and the fixing openings such, that the means of attachment may move from the positioning opening to the fixing opening with respect to the retaining means, but after having been fixed will be unable to move back from the fixing opening to the positioning opening with respect to the retaining means during operation or transport of the Jacquard weaving machine.

This has the advantage that the return springs may be positioned exactly on the retaining means through such means of attachment, it being possible to maintain the same pitch for the bottom frame as well as for the cumber board. Because of this, the harness functions with a minimum of friction and with a minimum number of collisions between the various components. Furthermore the return springs will be prevented from shifting forward and therefore no collisions with the reed will occur. Preventing the return springs from shifting backward and forward will ensure that the configuration of the shed will not be changed, so that any problems during weaving will be avoided.

In a preferred embodiment of a device according to the invention the positioning opening, where it is connected to the fixing opening, is provided with a beveled edge for guiding the motion of the means of attachment with respect to the retaining means from the positioning opening to the fixing opening.

This has the advantage that it has become easier to retract the retaining means into the fixing opening of the means of attachment.

In an advantageous preferred embodiment of a device according to the invention, the fixing opening, where it is connected to the positioning opening, is provided with a sharp and practically flat edge, such that after the means of attachment having been fixed with respect to the retaining means, the means of attachment are no longer able to move back from the fixing opening to the positioning opening during operation or transport of the Jacquard weaving machine.

In a more advantageous preferred embodiment of the device according to the invention, the spring connection between the positioning opening and the fixing opening is provided with at least two protrusions situated opposite one another.

This ensures that the motion of the retaining means from the fixing opening to the positioning opening is made still more difficult.

In the most advantageous preferred embodiment of a device according to the invention, the protrusion, situated in the spring connection on the side of the fixing opening, is provided in order to engage a recess provided in the retaining means.

In this manner, the means of attachment are no longer able to move from the fixing opening to the positioning opening.

Preferably, the retaining means are carried out in the form of a flat bar, at least one recess being provided on at least one side of the flat bar for the means of attachment to be fixed to the flat bar.

More preferably, at least one recess is provided on two sides of the flat bar for the means of attachment to be fixed to the flat bar.

Still more preferably, the flat bar, on two sides, is provided with several recesses in order to be able to fix several means of attachment to the flat bar.

Another disadvantage of the known means of attachment described above is that the hook is a metal hook. Because of this there is more clearance between the hook and the flat bar and vibrations will occur. Furthermore the metal hook will easily detach itself from the flat bar.

An additional purpose of the invention therefore consists in providing a device having one or several of the characteristics of this invention, but the clearance between the means of attachment and the retaining means is less, and the means of attachment will become less easily detached from the retaining means.

These purposes are obtained by providing a device according to the present invention, the means of attachment being made of synthetic material.

The combination of means of attachment and retaining means made of synthetic material in the shape of flat bars is suitable for regulating the return springs very easily when pre-leveling the harness and to pre-install them on the flat bars and to secure them in that position.

Furthermore it is known in a Jacquard weaving machine to suspend the flat bars in the recesses of two plates which are laterally attached to the outside of the back and the front of a frame. This frame consists of two tubes, which are connected to one another by connecting pieces.

One the one hand, the disadvantages of such a design are that it takes up much space as to height and on the other hand it is composed of a large number of components.

On the other hand therefore, the purpose of the invention is to provide a device for immovably installing the retaining means of one or several return springs of a Jacquard weaving machine not having the above-mentioned disadvantages.

This purpose of the invention is achieved by providing a device for immovably installing the retaining means of one or several return springs of a Jacquard weaving machine, the device being provided with at least two fixed installing elements for installing the retaining means, but said installing elements being provided with one or several recesses to install the retaining means.

By directly installing the retaining means in the two fixed installing elements, the total height may be reduced and moreover the construction has a good deal less components which reduces the time for installation and the price.

In a preferred embodiment of a device according to the invention, the said installing elements have the shape of a tube, each tube being provided with one or several grooves in order to insert the retaining means.

In a specific preferred embodiment of the device according to the invention, said retaining means consist of a flat bar, several recesses being provided on two sides of the flat bar for fixing several return springs to the flat bar and the two other sides of the flat bar being provided for being inserted into said grooves of the tubes.

In an advantageous preferred device according to the invention, said tubes are put at an over- or subatmospheric pressure in order to keep said flat bars free of dust.

This invention will now be further explained by means of the following detailed description of a preferred embodiment according to the invention. The intention of this description is exclusively to give a clarifying example and to indicate the further advantages and particulars of the present invention and may therefore in no way interpreted as a restriction of the field of application of the invention or of the patent right demanded for in the claims.

BRIEF DESCRIPTION OF THE DRAWINGS

In this detailed description reference is made, by means of reference numbers, to the attached drawings in which.

DETAILED DESCRIPTION OF THE PREFERRED EMBODIMENTS

In a Jacquard machine each hook is connected to one or several cords, the whole of the cords being called the harness. The extremity of each cord is connected to a heddle eye through which a warp yarn is running, in order to form a shed by an up and down movement of the heddle eye and consequently also of the warp yarn. The heddle eye is connected to the frame of the Jacquard weaving machine by means of a return spring, which is usually connected to means of attachment on retaining means, more particularly a flat bar, which is provided immovably, preferably by incorporating it in the Jacquard weaving machine.

Figure 1:
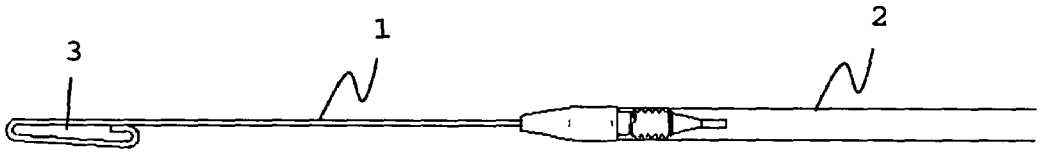
in FIG. 1 a means of attachment is represented for attaching a return spring to a flat bar of a Jacquard weaving machine according to the state-of-the-art.
Figure 2:
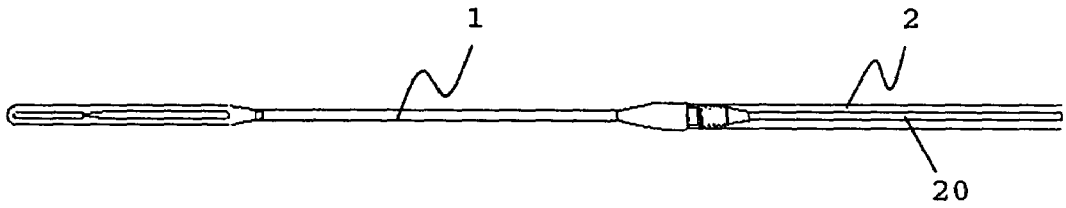
in FIG. 2 a means of attachment is represented for attaching a return spring to a flat bar of a Jacquard weaving machine according to the invention.

As shown in FIGS. 1 and 2 the means of attachment (1) are preferably screwed onto the return spring (2). Damping means (20) have been provided or not. As shown in FIG. 2, these damping means (20) are built-in, to prevent the extremity of the return spring (2) from absorbing the heaviest chocks. Preferably, these damping means (20) consist of an element made of synthetic material which is situated in the return spring (2).

According to the state-of-the-art, the means of attachment (1) are provided with a hook (3), which usually is made of metal. This metal hook (3) is hooked onto a flat bar (4), as shown in FIGS. 3 and 4.

Figure 3:
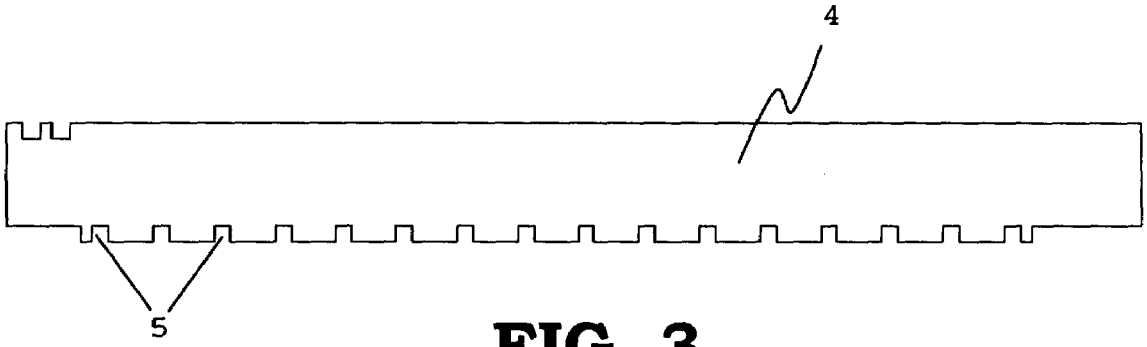
in FIG. 3 a first embodiment of a flat bar of a Jacquard weaving machine according to the invention is represented.

As represented in FIG. 3 at least one recess (5) has been provided on at least one side of the flat bar (4) in order to fix the means of attachment (1) in an exact position. Preferably several recesses (5) are provided in order to be able to fix several means of attachment (1) of several return springs (2).

Figure 4:
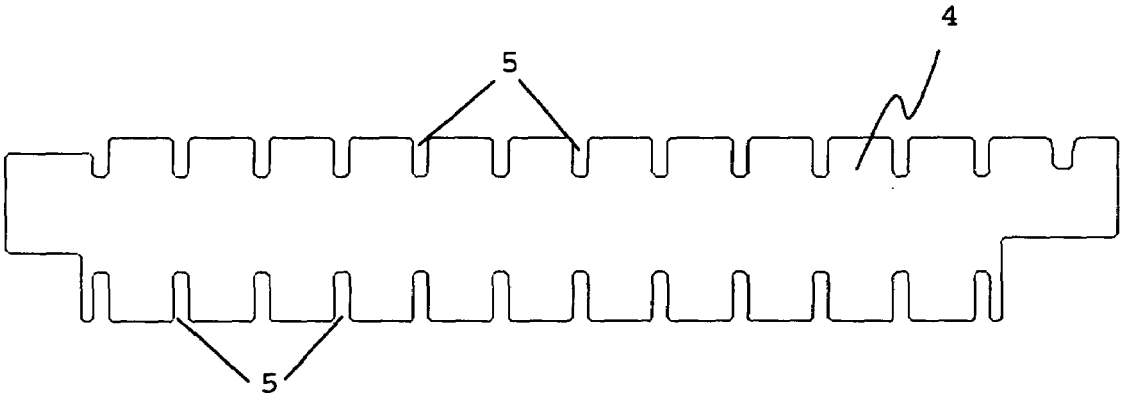
in FIG. 4 a second embodiment of a flat bar according to the invention is represented.
Figure 5:
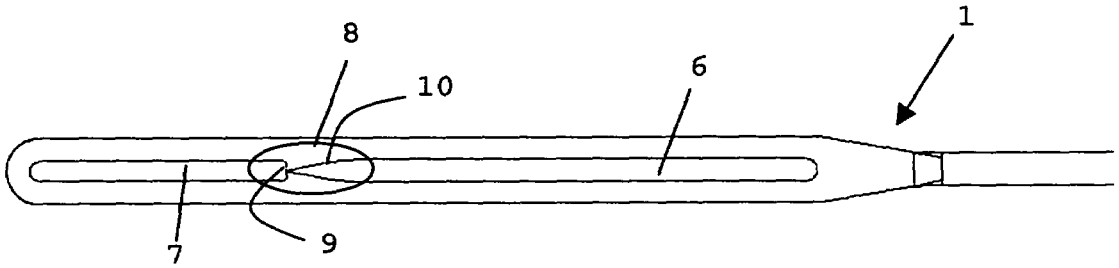
in FIG. 5 a first embodiment of a means of attachment according to the invention is represented.

Preferably the flat bar (4) comprises several recesses (5) on both sides for fixing several return springs (2), as represented in FIG. 4, This will add to a greater stability of the whole.

The means of attachment (1) according to the invention are provided with two openings, more particularly a positioning opening (6) for positioning the means of attachment (1) with respect to the flat bar, and a fixing opening (7) for fixing the means of attachment (1) with respect to the flat bar (4). The positioning opening (6) ensures that the means of attachment (1) may shift all along the entire circumference of the flat bar (4) up to the exact position where the flat bar (4) is pulled, through the recess (5), into the fixing opening (7) of the means of attachment (1). The means of attachment (1) are intended to be able to move from the positioning opening (6) to the fixing opening (7) with respect to the flat bar (4), but after having been fixed with respect to the flat bar (4) should be unable to move back from the fixing opening (7) to the positioning opening (6) during operation or transport of the Jacquard machine. To that effect, a spring connection is provided between the positioning opening (6) and the fixing opening (7).

In a first embodiment of the means of attachment (1) for attaching a return spring (2) to a flat bar (4) in a Jacquard weaving machine, this spring connection (8) is realized by providing a sharp and practically flat edge (9) in the fixing opening (7). Consequently, the means of attachment (1) will be unable to move from the fixing opening (7) to the positioning opening (6) with respect to the flat bar (4) during operation or transport of the Jacquard machine. In order to guide the motion of the means of attachment (1) from the positioning opening (6) to the fixing opening (7) with respect to the flat bar (4), a beveled edge (10) is provided in the positioning opening (6).

Figure 6:
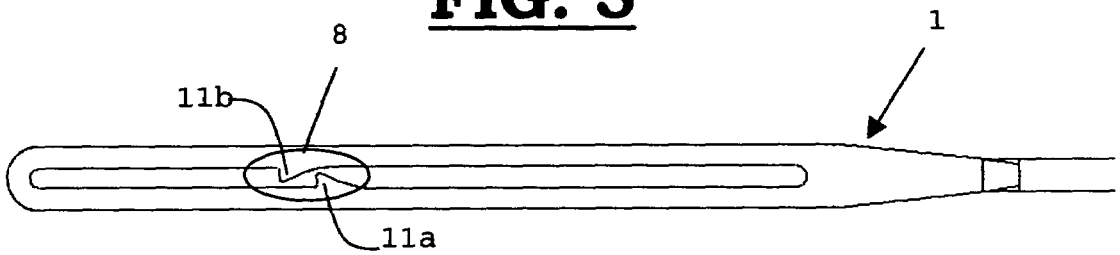
in FIG. 6 a second embodiment of a means of attachment according to the invention is represented.

In a second embodiment of a spring connection (8) according to the invention, as represented in FIG. 6, two protrusions situated opposite one another, an upper (11*a*) and a lower (11*b*) protrusion, have been provided, together forming a kind of labyrinth. The purpose of this labyrinth is to make it yet more difficult for the means of attachment (1) to become detached with respect to the flat bar (4) during operation or transport of the Jacquard machine.

Figure 7:
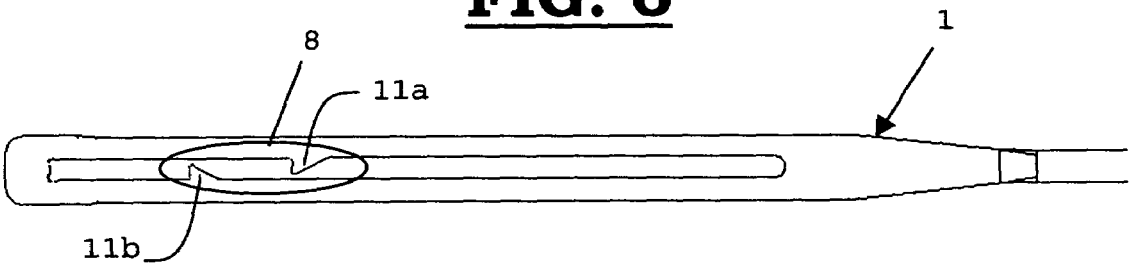
in FIG. 7 a third embodiment of a means of attachment according to the invention is represented.
Figure 8:
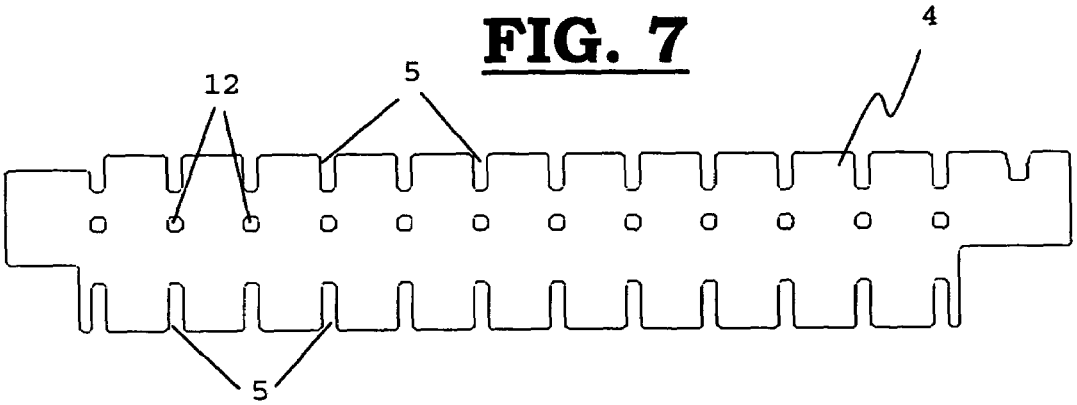
in FIG. 8 a third embodiment of a flat bar according to the invention, working together with the third embodiment of a means of attachment according to the invention, as represented in FIG. 6, is represented.

In a third embodiment of a spring connection (8) according to the invention, as represented in FIG. 7, the two protrusions (11*a*, 11*b*) of the labyrinth are moved further apart from one another. The upper protrusion (11*a*) is able to engage a recess (12), which has been provided, in the flat bar (4), as represented in FIG. 8. In this manner, it is almost impossible for the means of attachment (1) to become detached with respect to the flat bar (4) during operation or transport of the Jacquard machine.

Preferably the means of attachment (1) are made of synthetic material.

Figure 9:
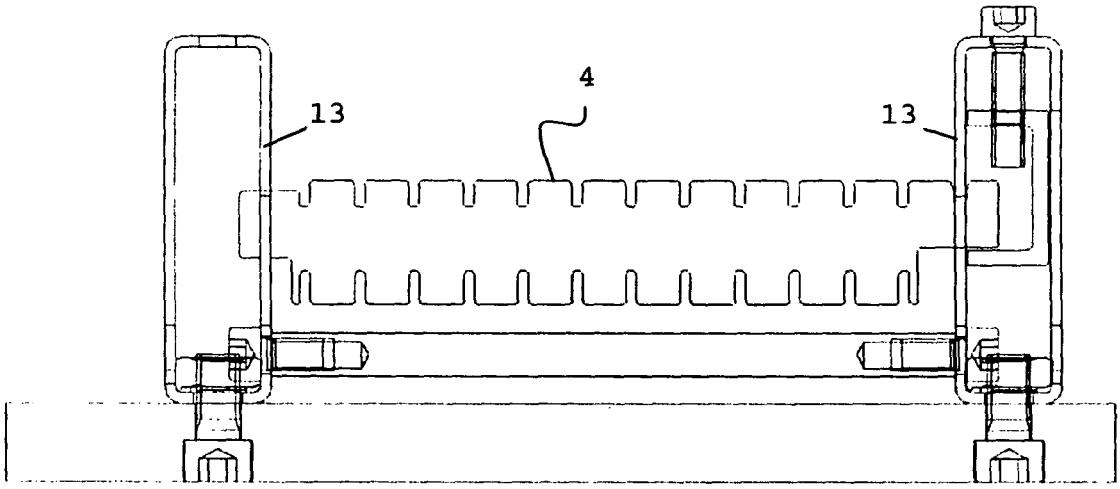
in FIG. 9 a device is represented for immovably installing one or several flat bars in a Jacquard weaving machine provided with two fixed installing elements for installing the retaining means.

The flat bars (4) are carried out such that they may be immovably installed in a simple manner in the Jacquard weaving machine. Each flat bar (4) is inserted in two installing elements in the shape of a set of tubes (13) as represented in FIG. 9. These tubes (13) are provided with one or several grooves into which one or several flat bars (4) may be slid. Because of this, each flat bar (4) may take up an exact position in the Jacquard weaving machine. By attaching the flat bar (4) to the tubes (13), the tubes (13) may be put at a subatmospheric pressure or an overpressure in order to keep the flat bar (4) free of dust. Because this construction allows for a simple installation of the flat bars (4), it also offers the opportunity to build a more compact installation, which is an essential advantage in view of the building requirements for operating such installations.

What is claimed is:

1. Device for exerting a return force on at least one harness element of the harness of a Jacquard weaving machine, comprising at least one return spring (2) provided with means of attachment (1) for attaching the return spring (2) to retaining means (4) immovably provided, wherein said means of attachment (1) are provided with a positioning opening (6) for positioning the means of attachment (1) with respect to the retaining means (4), and a fixing opening (7) for fixing the means of attachment (1) to the retaining means (4), a spring connection (8) being provided between the positioning opening (6) and the fixing opening (7), such that the means of attachment (1) are able to move from the positioning opening (6) to the fixing opening (7) with respect to the retaining means (4), but will be unable, after having been fixed with respect to the retaining means (4), to move back from the fixing opening (7) to the positioning opening (6) during operation or transport of the Jacquard machine.

2. Device according to claim 1, wherein the positioning opening (6), where it is connected to the fixing opening (7), is provided with a beveled edge (10) in order to guide the motion of the means of attachment (1) with respect to the retaining means (4) from the positioning opening (6) to the fixing opening (7).

3. Device according to claim 1, wherein the fixing opening (7), where it is connected to the positioning opening (6), is provided with a sharp and practically flat edge (9), such that after fixing the means of attachment (1) with respect to the retaining means (4), the means of attachment will be unable to move back from the fixing opening (7) to the positioning opening (6) during operation or transport of the Jacquard machine.

4. Device according to claim 1, wherein the spring connection (8) between the positioning opening (6) and the fixing opening (7) is provided with at least two protrusions (11*a*, 11*b*), situated opposite one another.

5. Device according to claim 4, wherein the protrusion which is situated in the spring connection (8) on the side of the fixing opening (7), is provided to engage a recess (12), which is provided in the means of attachment (4).

6. Device according to claim 1, wherein the means of attachment are carried out in the form of a flat bar (4), at least one recess (5) being provided on at least one side of the flat bar (4) in order to fix the means of attachment (1) to the flat bar (4).

7. Device according to claim 6, wherein at least one recess (5) is provided on two sides of the flat bar (4), in order to fix the means of attachment (1) to the flat bar (4).

8. Device according to claim 7, wherein the flat bar (4) on the two sides is provided with several recesses (5) in order to be able to fix several means of attachment (1) to the flat bar (4).

9. Device according to claim 1, wherein the means of attachment (1) are made of synthetic material.

10. A system comprising a device for immovably installing a means of attachment (1) of one or several return springs (2) of a Jacquard weaving machine comprising at least two fixed installing elements (13) for installing retaining means (4), the installing elements (13) comprising one or several recesses for applying the retaining means (4) further comprising, in combination, a device for exerting a return force on at least one harness element of the harness of a Jacquard weaving machine, comprising at least one return spring (2) provided with the means of attachment (1) for attaching the return spring (2) to the retaining means (4) immovably provided, the means of attachment (1) comprising a positioning opening (6) for positioning the means of attachment (1) with respect to the retaining means (4), and a fixing opening (7) for fixing the means of attachment (1) to the retaining means (4), a spring connection (8) being provided between the positioning opening (6) and the fixing opening (7) enabling the means of attachment (1) to move from the positioning opening (6) to the fixing opening (7) with respect to the retaining means (4), but after having been fixed with respect to the retaining means (4) the means of attachment being unable to move back from the fixing opening (7) to the positioning opening (6) during operation or transport of the Jacquard machine.

11. Device according to claim 10, wherein said installing elements have the shape of a tube, in each tube (13) one or several grooves being provided in order to insert the retaining means (1).

12. Device according to claim 11, wherein said retaining means consist of a flat bar (4), several recesses being provided on two sides of the flat bar (4) for fixing several return springs (2) to the flat bar (4), and the other two sides of the flat bar (4) being provided to be inserted into the said grooves of the tubes (13).

13. Device according to claim 12, wherein said tubes (13) may be put at an overpressure or an subatmospheric pressure, in order to keep said flat bars (4) free from dust.

* * * * *